United States Patent [19]

Numata

[11] Patent Number: 4,602,194

[45] Date of Patent: Jul. 22, 1986

[54] EXCITING CIRCUIT FOR ELECTRONIC FLASH DEVICE

[75] Inventor: Saburo Numata, Ohmiya, Japan

[73] Assignee: Fuji Photo Optical Co., Ltd., Tokyo, Japan

[21] Appl. No.: 508,471

[22] Filed: Jun. 27, 1983

[30] Foreign Application Priority Data

Jul. 2, 1982 [JP] Japan ..... 57-115259

[51] Int. Cl.[4] ..... H05B 37/00

[52] U.S. Cl. ..... 315/241 P; 354/416

[58] Field of Search ..... 315/241 P, 243; 354/416, 417, 418, 127.12

[56] References Cited

U.S. PATENT DOCUMENTS 4,225,218 9/1980 Numata ..... 354/418
4,275,335 3/1980 Ishida ..... 315/241 P
4,344,680 8/1982 Ishida et al. ..... 315/241 P X

*Primary Examiner*—David K. Moore
*Attorney, Agent, or Firm*—Pasquale A. Razzano

[57] ABSTRACT

An excitation circuit for an electronic flash device for a photographic camera is arranged to energize the flashtube in a plurality of successive steps for each shot. In each of the successive steps, the flashtube is energized only for a time interval which is shorter than the time interval required by the flashtube to operate at its full power. This keeps the proportion of infrared radiation to a minimum.

7 Claims, 3 Drawing Figures

EXCITING CIRCUIT FOR ELECTRONIC FLASH DEVICE

BACKGROUND OF THE INVENTION

1. Field of the Invention

This invention relates to an excitation circuit for an electronic flash device for a photographic camera, and more particularly to an exciting circuit for an electronic flash device which is particularly suitable for use with a photographic camera having a focal-plane shutter.

2. Description of the Prior Art

In conventional electronic flash devices, the excitation circuit has been arranged to operate the flashtube at its full power once for one shot. Generally, the maximum amount of light which can be emitted from the flashtube is limited according to the size of the flashtube. That is, the maximum light emissive power of the flashtube is determined according to the temperature of the flashtube which depends upon the balance of heat produced by infrared rays included in the emission of the flashtube with the heat dissipation from the flashtube to the atmosphere and to the elements supporting it. Because the flashtube must be operated within a certain working temperature range which is determined taking into account the deterioration rate and breakage of the flashtube, the maximum light emissive power of larger flashtubes having a larger contact area with the atmosphere is inherently larger than that of the smaller ones.

Thus, an attempt to miniaturize the electronic flash device to build it in the camera body encounters a problem that sufficient amount of light cannot be emitted from a small flashtube. However, since the flashtube shares the majority of the overall size of the electronic flash device, the flashtube must be small in order to miniaturize the electronic flash device.

Further, as is well known, the electronic flashtube to be built in a photographic camera having a focal plane shutter is desired to have an emission characteristics curve having a long durable flat peak.

SUMMARY OF THE INVENTION

In view of the foregoing observations and description, the primary object of the present invention is to provide an excitation circuit for an electronic flash device which permits even a small flashtube to emit a sufficient amount of light required in taking a photograph.

Another object of the present invention is to provide an excitation circuit capable of realizing a built-in electronic flash device which exhibits an emission characteristics having a long durable flat peak and is, accordingly, particularly suitable for use with a photographic camera having a focal-plane shutter.

When an electronic flashtube is operated at its full power as in the conventional electronic flash devices, the flashtube exhibits an emission characteristics as shown in FIG. 1. There has been known a fact that the infrared component included in the emission of the flashtube is only about 1% of visible light in the leading edge region while in the remaining region, it reaches up to about 10% of the same.

The excitation circuit of the present invention is arranged to energize the flashtube in a plurality of successive steps for one shot, in each of the successive steps the flashtube being energized only for a time interval which is shorter than the time interval required by the flashtube to operate at its full power, or substantially corresponds to the leading edge region of the emission characteristics curve of the flashtube which is operated at its full power. The emission characteristics curve of an electronic flash device employing the exciting circuit of the present invention is as shown in FIG. 2. The arrangement of the excitation circuit of the present invention is advantageous in that the flashtube can be excited for a long time without significantly raising its temperature since only a small amount of infrared component is included in the emission of the flashtube in each step, and therefore, there can be totally emitted from he flashtube an amount of light which is very large for the size of the flashtube and is larger than the amount of light obtained when the flashtube is operated once at its full power. Further, as can be seen from FIG. 2, the emission characteristics of the flashtube excited by the excitation circuit of the present invention is particularly suitable for the camera provided with a focal-plane shutter in which the emission characteristics of the flashtube is desired to have a long durable flat peak.

The excitation circuit for an electronic flash device of the present invention comprises means for generating a trigger pulse which is durable for a predetermined time interval and permits a trigger voltage to be imparted to the trigger electrode, a pulse generator for generating a plurality of timing pulses during existence of the trigger pulse, each timing pulse being of a duration of a time interval shorter than the time interval required by the flashtube to operate at its full power, switching means which turns on and off to close and open the electric circuit for establishing an electric voltage between the anode and the cathode, and a gate circuit for turning the switching means on when both the timing pulse and the trigger pulse exist.

DESCRIPTION OF THE PREFERRED EMBODIMENT

Figure 1:
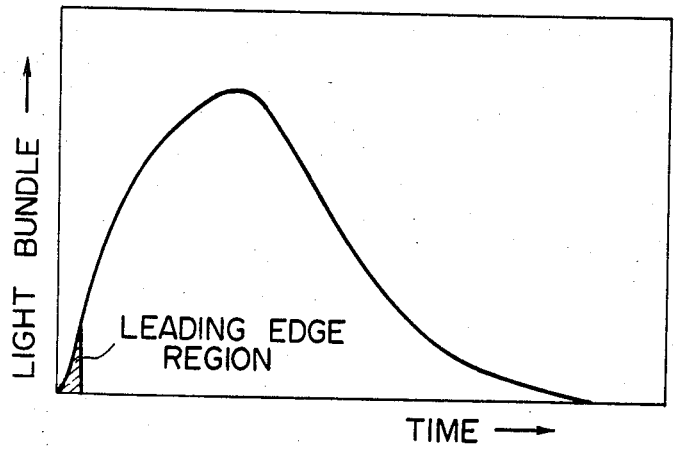
FIG. 1 PRIOR ART
FIG. 1 is a graph showing the emission characteristics of the conventional electronic flash device.
Figure 2:
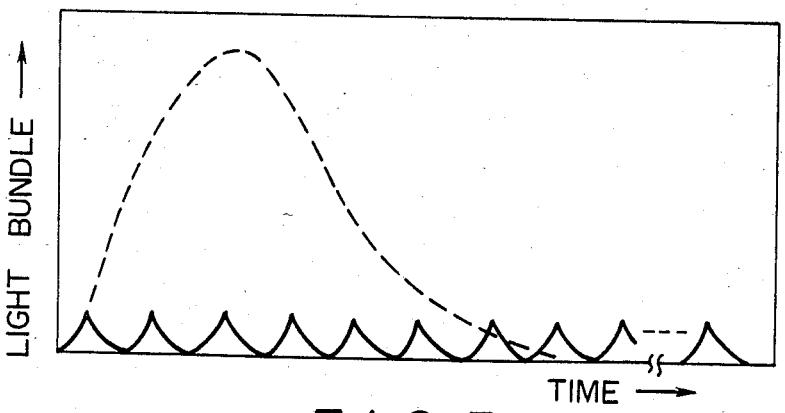
FIG. 2 is a graph showing the emission characteristics of the electronic flash device employing the exciting circuit of the present invention.
Figure 3:
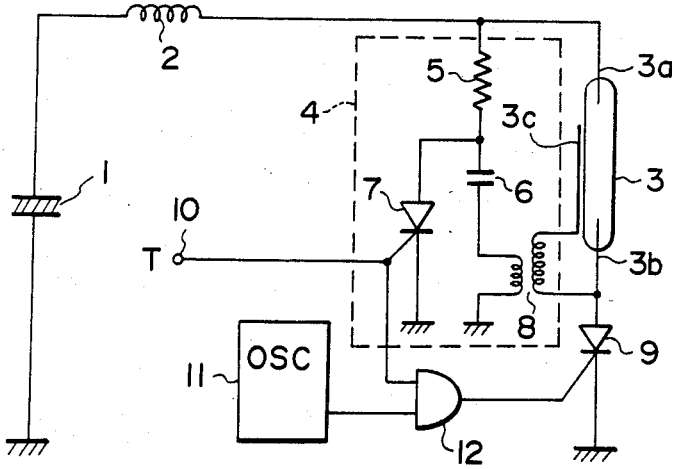
FIG. 3 is a circuit diagram of an exciting circuit for an electronic flash device in accordance with an embodiment of the present invention.

In FIG. 3, which is a circuit diagram of an excitation circuit in accordance with an embodiment of the present invention, a main capacitor 1 for storing an electric charge for energizing a flashtube 3 is connected to the anode 3*a* of the flashtube 3 and to a resistor 5 in a trigger circuit 4 by way of a ballast coil 2. The ballast coil 2 is for delaying the operation of the flashtube 3. The cathode 3*b* of the flashtube 3 is connected to a gate turn-off thyristor 9 which turns on and off the electric current to the flashtube 3, and to one end of the secondary winding of a trigger transformer 8 in the trigger circuit 4. The other end of the secondary winding of the trigger transformer 8 is connected to the trigger electrode 3*c* of the flashtube 3. The cathode of the gate turn-off thyristor 9 is grounded. A trigger terminal 10 for feeding trigger pulses is connected to the gate of a thyristor 7 which closes and opens a discharging circuit including the primary winding of the trigger transformer 8 and to one of the input terminals of an AND circuit 12. The AND circuit 12 outputs the positive product of the timing pulse fed from the trigger terminal 10 and an output pulse of a pulse generator 11. The pulse generator 11 generates pulses for controlling the timing of energizing the flashtube 3 and the output terminal of the generator 11 is connected to the other input terminal of the AND circuit 12. The pulse generator 11 may be one whose timing accuracy is not so high such as a CR oscillator using a CR time constant circuit, or a crystal oscillator whose timing accuracy is very high, or may be even one which generates irregular pulses. The output terminal of the AND circuit 12 is connected to the gate of the gate turn-off thyristor 9. The AND circuit 12 may comprise any devices or any gate insofar as it can output the positive logical product of the trigger pulse fed from the trigger terminal 10 and the output pulse of the pulse generator 11. Further, a transistor may be used in place of the gate turn-off thyristor 9. One end of the primary winding of the trigger transformer 8 is grounded while the other end of the same is connected to the anode of the thyristor 7 by way of a trigger capacitor 6. Said resistor 5 charging the trigger capacitor 6 is connected between the capacitor 6 and the thyristor 7. The cathode of the thyristor 7 is grounded.

When the main capacitor 1 is charged by a boosting circuit (not shown), the voltage of the main capacitor 1 is imparted to the anode 3*a* of the flashtube 3 through the ballast coil 2 and at the same time charges the trigger capacitor 6. The level of the trigger pulse from the trigger terminal 10 is normally low, and the tyristor 7 is kept in off condition. The gate turn-off thyristor 9 is also kept in off condition.

When the shutter button, for example, is depressed and the level of the trigger pulse from the trigger terminal 10 turns high, the level at the gate of the thyristor 7 becomes high to turn the thyristor 7 on. This permits the trigger capacitor 6 to discharge through the thyristor 7 and the primary winding of the trigger transformer 8. The electric current flowing through the primary winding of the trigger transformer 8 induces a high voltage in the secondary winding of the same. The induced high voltage is imparted to the trigger electrode 3*c* of the flashtube 3. At the same time, the trigger pulse from the trigger terminal 10 at high level is imparted to the input terminal of the AND circuit 12. Therefore, when the level of the output pulse of the pulse generator 11 turns high, the level at the gate of the gate turn-off thyristor 9 becomes high to turn on the gate turn-off thyristor 9, whereby the cathode 3*b* of the flashtube 3 is grounded. Thus, the flashtube 3 discharges to emit light by the voltage established between the anode 3*a* and the cathode 3*b* and the high voltage imparted to the trigger electrode 3*c*. The level of the output pulse of the pulse generator 11 is turned low within the leading edge region of the emission characteristics of the flashtube 3, and thereby the gate voltage of the gate turn-off thyristor 9 changes from high to low to turn the thyristor 9 off. This interrupts emission of the flashtube 3. When the level of the output pulse of the pulse generator 11 subsequently changes from low to high, the gate voltage of the gate turn-off thyristor 9 turns high to turn the thyristor 9 on again. Accordingly, the cathode 3*b* of the flashtube 3 is again grounded, and a voltage is again established between the anode 3*a* and the cathode 3*b*. As is well known, residual ions are produced when the flashtube once discharges to emit light, and the flashtube can discharge again by imparting a voltage between the anode and cathode before the residual ions are extinguished without imparting a high voltage to the trigger electrode. Therefore, when the thyristor 9 is turned on again and the cathode 3*b* of the flash tube 3 is grounded again, the flashtube 3 discharges again. The flashtube 3 continues to repeat discharge in synchronization with the output pulse of the pulse generator 11 until the voltage of the main capacitor 1 is lowered not to discharge any more.

The value of the peak of the emission characteristics of the electronic flash device obtained in accordance with the present invention can be controlled by changing the duty cycle of the output pulse of the pulse generator 11.

I claim:

1. An excitation circuit for an electronic flash tube having a trigger electrode, an anode, and a cathode, comprising means for generating a trigger pulse of a duration of a trigger time interval;

means responsive to said trigger pulse for imparting a trigger voltage to said trigger electrode;

pulse generator means for generating a series of timing pulses during the existence of each trigger pulse, each timing pulse having a predetermined duration of a brief time interval shorter than the time interval required by the flash tube to operate at its full power;

switching means for turning on and off to close and open the electric circuit for establishing an electric voltage between the anode and the cathode of said flash tube; and gate circuit means with inputs coupled respectively to receive said trigger pulse and said timing pulses for turning the switching means on only when both the timing pulse and the trigger pulse are occurring, the predetermined duration of the timing pulses and the separation between them being selected for intermittently and repeatedly energizing said flash tube such that the flash tube is energized only at a leading edge portion of its emission characteristic and to a power level below its maximum power level, thereby minimizing the proportion of infrared radiation in the light generated in the photo tube.

2. An excitation circuit as defined in claim 1 in which said trigger pulse and the timing pulses are both of like electrical sense, and said gate circuit means outputs a logical product of the trigger pulse and the timing pulses, said switching means having an input coupled to the gate circuit means to receive said logical product to be turned on when the output of the gate circuit means is said electrical sense.

3. An excitation circuit as defined in claim 1 or 2 in which said switching means includes a gate turn-off thyristor.

4. An excitation circuit as defined in claim 1 or 2 in which said switching means includes a transistor.

5. An excitation circuit for a miniaturized electronic flash device to be incorporated in a camera body, comprising an electronic flashtube having a trigger electrode, an anode, and a cathode;

means for generating a trigger pulse of a duration of a trigger time interval;

means responsive to said trigger pulse for imparting a trigger voltage to said trigger electrode;

means for establishing an electric voltage between said anode and said cathode of the flashtube; and means for repeatedly interrupting and reestablishing current flow between the anode and cathode of said flashtube during occurrence of said trigger pulse such that the flashtube is energized repeatedly only for a leading edge portion of its emission characteristic, thereby minimizing the proportion of infrared radiation contained in the light generated in the flashtube.

6. An excitation circuit for a flash unit to be employed with a camera having a focal plane shutter, and providing light emission of a long-duration characteristic, comprising an electronic flashtube having a trigger electrode, an anode, and a cathode;

means for generating a trigger pulse of a duration of a trigger time interval;

means responsive to said trigger pulse for imparting a trigger voltage to said trigger electrode;

means for establishing an electric voltage between said anode and said cathode of the flashtube; and means for continually interrupting and reestablishing current flow between the anode and cathode of said flashtube during occurrence of said trigger pulse such that the flashtube is energized repeatedly to a power level below its maximum power level at a series of intervals during the duration of the trigger time interval.

7. An excitation circuit as defined in claim 5 or 6, wherein said means for interrupting includes a pulse generating circuit generating timing pulses of a predetermined duration and pulse interval and a switching device coupled in series with said anode and cathode and having an input responsive to the timing pulses, said timing pulses, having said duration and pulse interval selected to reestablish the current between said anode and cathode before residual ions in the flashtube are extinguished.

* * * * *